US010179258B1

(12) United States Patent
Sabbagh

(10) Patent No.: US 10,179,258 B1
(45) Date of Patent: Jan. 15, 2019

(54) APPARATUS AND SYSTEM FOR AN INTEGRATED EXERCISE DEVICE

(71) Applicant: FIT & TONED, LLC, Frisco, TX (US)

(72) Inventor: Ranya Sabbagh, Frisco, TX (US)

(73) Assignee: FIT & TONED, LLC, Frisco, TX (US)

( * ) Notice: Subject to any disclaimer, the term of this patent is extended or adjusted under 35 U.S.C. 154(b) by 0 days.

(21) Appl. No.: 15/891,204

(22) Filed: Feb. 7, 2018

(51) Int. Cl.

| | |
|---|---|
| ***A63B 21/04*** | (2006.01) |
| ***A63B 21/00*** | (2006.01) |
| ***A63B 23/04*** | (2006.01) |
| ***A63B 23/12*** | (2006.01) |
| ***A63B 23/035*** | (2006.01) |

(52) U.S. Cl.
CPC ..... *A63B 21/0442* (2013.01); *A63B 21/4015* (2015.10); *A63B 21/4033* (2015.10); *A63B 23/0355* (2013.01); *A63B 23/0482* (2013.01); *A63B 23/1236* (2013.01)

(58) Field of Classification Search
CPC ..... A63B 21/0442; A63B 21/4015; A63B 21/4033; A63B 21/00047; A63B 21/00178; A63B 21/02; A63B 21/04; A63B 21/055; A63B 21/0552; A63B 23/0355; A63B 23/1236; A63B 23/0482
See application file for complete search history.

(56) References Cited

U.S. PATENT DOCUMENTS 3,540,724 A * 11/1970 Hunter ..... A63B 21/00047 482/121
4,102,336 A * 7/1978 Wiener ..... A61H 1/0218 606/241
4,198,044 A * 4/1980 Holappa ..... A63B 21/04 482/130
5,417,636 A 5/1995 Havens
6,220,994 B1 4/2001 Rich
6,299,569 B1 10/2001 Rich
8,721,507 B2 5/2014 Blancher
9,259,606 B2 * 2/2016 Wolan ..... A63B 21/0442
2010/0285925 A1 * 11/2010 Pierce ..... A63B 6/00 482/8
2015/0238799 A1 * 8/2015 Arline ..... A63B 21/0442 482/129

FOREIGN PATENT DOCUMENTS

CN 2857990 B1 1/2007

* cited by examiner

*Primary Examiner* — Megan Anderson

(57) ABSTRACT

An apparatus, system, and method for using a portable exercise device. Various exercises are performable using the exercise device, including standing, sitting, and kneeling exercises that are particularly suited for resistance training. The portable exercise device includes a frame defining an empty space. The portable frame includes a top bar parallel to a bottom bar, and two side bars including a first side bar and a second side bar, as well as a first frame handle and a second frame handle. The first frame handle and the second frame handle are affixed substantially near an upper portion of the first side bar and the second side bar. The first frame handle and the second frame handle are in horizontal alignment with respect to each other. The portable exercise frame includes a set of attachment points distributed around the portable exercise frame configured to receive resistance bands.

20 Claims, 13 Drawing Sheets

APPARATUS AND SYSTEM FOR AN INTEGRATED EXERCISE DEVICE

BACKGROUND

The benefits of resistance training are so numerous that some level of resistance training is recommended for all ages and types of exercisers. There are many physical and mental benefits from resistance training including improved muscle strength and tone, which also helps to protect one's joints against injury, weight loss, reduction in fat, improved posture, and improved mobility and balance to name a few. In addition to the above, research demonstrates that resistance exercise training has profound effects on the musculoskeletal system and helps to prevent or reduce the risk of osteoporosis, lower-back pain, and many other disabilities. Such research has also demonstrated that virtually all the benefits of resistance training may be obtained in relatively short (e.g. approximately 15-20 minute (without limitation thereto) training sessions a few times a week) to help control chronic conditions such as diabetes, heart disease, arthritis, back pain, depression, and obesity.

To perform resistance training or weight lifting, most people think of using weight machines such as those large and expensive machines that may be found at one's local gym or club. These weight machines are usually too large to be used in the convenience of one's home or elsewhere, such as an outdoors setting. Further, a downside of these weight machines is that they usually focus on only one or two muscle groups, and can only be used to perform a very narrow, limited range of exercises.

Different types of devices and exercisers have been designed to assist with performing some resistance type exercises using various boards and platforms. However, these devices are still lacking because they do not provide the ability to perform a vast variety of exercises, including many that are highly recommended to be incorporated in one's resistance training, such as, without limitation, push-ups, hip thrusts, standing or kneeling kicks, and a whole host of other types of exercises that are beneficial to the body.

Further, such conventional devices are often heavy and therefore are not easily transportable. Additionally, these conventional devices are not designed to allow a user to perform various training exercises from a standing position and to work on the different muscles that benefit from having this angle of workout. Accordingly, there is still a great need for a workout apparatus and system that allows a user to focus on resistance training that overcomes the many shortcomings of conventional devices.

SUMMARY

In one aspect, embodiments in the present description are directed to an exercise device that is portable and relatively lightweight. In one or more embodiments, the exercise device includes a frame that defines an empty space. A frame may include a top bar and a bottom bar that are parallel to one another, and two side bars perpendicular to the top and bottom bars. A top end of each side bars may be coupled to each end of a top bar, while a bottom end of each side bar may be coupled to each end of the bottom bar. The top bar, bottom bar, and side bars may be coupled to form a substantially rectangular shape, in one or more non-limiting examples.

The frame may further include at least two frame handles for a user to grasp and utilize during his or her workouts. In one embodiment, a frame handle may be located on one side bar and another frame handle may be located on the second side bar, whereby the frame handles are generally horizontally aligned in placement on the different side bars of the frame. Further, the frame handles may be positioned substantially near an upper portion of the side bars and may angle outwardly away from the frame.

In one or more non-limiting embodiments, the frame may also include one or more attachment points that may be useful for clipping one or more resistance bands to the attachment points. In one or more non-limiting examples, the one or more attachment points may be ring like elements, including half circle shaped rings affixed to one or more bars of the frame.

In other aspects, embodiments in the present description are provided for an integrated system that includes an exercise device such as that described above. The exercise frame may be usefully placed horizontally flat on a working surface (e.g. ground surface, yoga mat, carpet, grass, etc.) or may be positioned vertically upright for a user to support while performing a number of exercises in either a standing, kneeling, or other position.

Embodiments are provided in the present description for an overall system of components that may be used to perform exercises on the exercise frame described above. For example, resistance bands are described herein that are made from a resilient, flexible, extendable band that can have a clip attached to each end of the resistance bands. One or more resistance band handles may include O rings (or another type of element for attachment) that may be removeably attached to the resistance bands during use.

Various unique exercises are also described herein that may be beneficial to a user's training. Such exercises include, without limitation, push ups, hip thrusts, squats, planks, reverse fly extensions, bent over row, deltoid extensions, triceps extensions, bicep extensions, standing donkey kicks, and kneeling donkey kicks, to name a few.

A special advantage of the exercise device described herein, according to one or more embodiments, is that it is both portable and light weight so that a user may easily transport the exercise device anywhere a user chooses to work out. Further, the exercise device is easily stored without taking up excessive space in one's home. In one or more embodiments, the frame is made of durable and sturdy materials to withstand a user's body weight.

Additionally, in one embodiment, the frame handles may be covered in ethylene propylene diene monomer (EPDM) rubber so that a user may easily grip the handles having a cushioned surface, which provides a stable support and reduces any pain or discomfort a user may feel in his or her wrists.

Other aspects and advantages of this disclosure will become apparent from the following detailed description.

DETAILED DESCRIPTION

Figure 1:
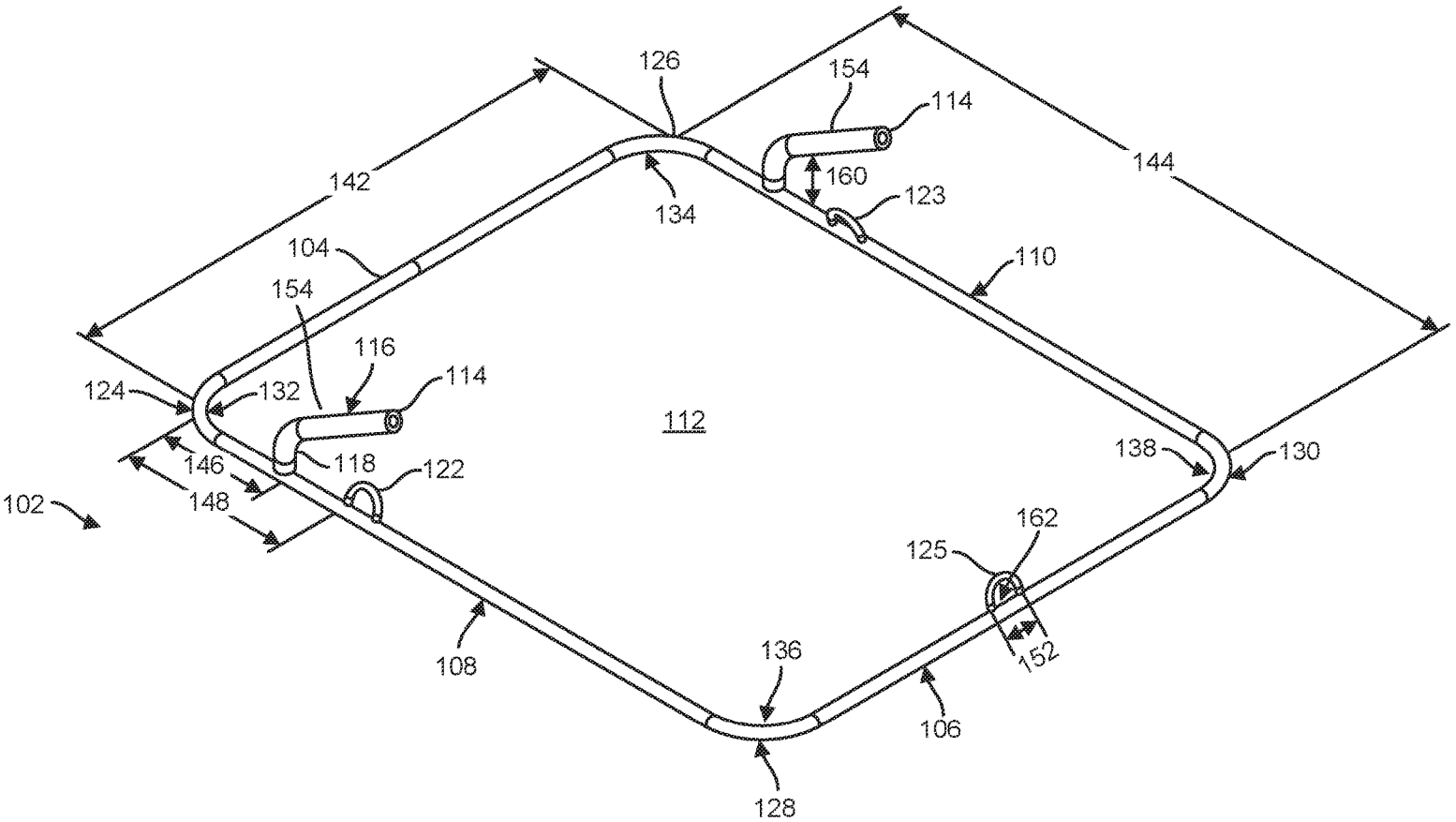
FIG. 1 is a pictorial view of an exercise device in accordance with one or more illustrative embodiments.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. it is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

References in the singular tense include the plural, and vice versa, unless otherwise noted. Further, as used herein, the term "coupled" or "coupling" may indicate a connection. The connection may be a direct or an indirection connection between one or more items. Further, the term "set" as used herein may denote one or more of any item, therefore the term "set" may denote one items, two items, three items, and so on and so forth.

Throughout the drawings, like reference characters are used to designate like elements. Further, the drawings are not to scale and depicted components or structures may have dimensions other than those depicted or perceived in the drawings.

Embodiments in the present description are drawn to an exercise device (or apparatus) configured to provide a tool for performing a variety of exercises, including exercises associated with resistance training and/or cardiovascular training. There are many useful applications for the one or more embodiments described in the current description, including but not limited to, personal training and exercise. As noted above, many people would like to work out in the convenience of their home or at any location that is convenient for them to work out. Gymnasiums require costly memberships. Further, many people tend to skip their work out training if it requires driving to a gymnasium and they do not have the time or ability to leave their families. Thus, there is still an existing need for a durable, portable exercise device that provides an effective workout tool for anyone to use and for a variety of exercises to be performed.

Turning to FIG. 1, FIG. 1 is a pictorial illustration of an exercise device in accordance with one or more non-limiting embodiments. Exercise device 102 includes one or more bar elements (e.g. bars 104, 106, 108, and 110) that are coupled to one another to form a frame. Accordingly, "exercise device" may be interchangeably referred to throughout the present description as "exercise frame" or "frame." Exercise device 102 is an integrated workout tool having a number of useful elements arranged on the body of exercise device 102 for a user to engage with when working out, and in particular, when in engaging in resistance training.

Exercise device 102 includes, in one or more non-limiting embodiments, top bar 104, bottom bar 106, first side bar 108, and second side bar 110. As shown in FIG. 1, top bar 104 is parallel to bottom bar 106, and first side bar 108 is parallel to second side bar 110. Further, a top end of first side bar 108 and a top end of second side bar 110 are coupled to each end of top bar 104. Similarly, a bottom end of first side bar 108 and a bottom end of second side bar 110 are coupled to each end of bottom bar 106.

When all of these bars are coupled together, exercise device 102 has four corners, including corners 124, 126, 128, and 130. As shown in the non-limiting embodiment in FIG. 1, exercise device 102 is generally rectangular shaped, but its exterior corners 124, 126, 128, and 130 are curved. Additionally, in this non-limiting embodiment, the interior corners 132, 134, 136, and 138 are also curved. In alternative embodiments, exterior corners 124-130 and interior corners 132-138 of exercise frame 102 may be perpendicular to each other such that exercise device 102 is generally rectangular shaped and has square edge corners for its exterior and/or interior joints. A person of ordinary skill in the art will appreciate that exercise device 102 may have other shapes, other than a rectangular shape, and still fall within the scope of the invention. Further, exercise device 102 may be manufactured so that each of its components, including top bar 104, bottom bar 106, first side bar 108, and second side bar 110 are separately manufactured and then joined together by any means known in the art (including without limitation via fasteners, welding, soldering, or any other means). Alternatively, top bar 104, bottom bar 106, first side bar 108, and. second side bar 110 may be integrally formed together.

Top bar 104, bottom bar 106, first side bar 108, and second side bar 110 each have a body and a thickness to each bar. As shown in the non-limiting embodiment in FIG. 1, each bar 104-110 is generally cylindrical shaped. In one non-limiting embodiment, each bar may be approximately ½ an inch in diameter. Further, in one or more non-limiting embodiments the overall lengths of top bar 104 and bottom bar 106 is somewhat shorter than the overall lengths of first side bar 108 and second side bar 110. For example, when assembled, width 142 of exercise device 102 may be approximately 24½ inches wide (e.g. whereby top bar 104 and bottom bar 106 are 24½ inches across including corners 124-130). In addition to the above, length 144 of exercise device 102 may be approximately 29½ inches long (e.g. whereby first side bar 108 and second side bar 110 are 29½ inches long including corners 124-130).

Those of ordinary skill in the art will appreciate that exercise device 102 and its components listed above may be designed having other dimensions and measurements without departing from the scope of this invention, and that these dimensions and measurements as described herein and throughout the present description are all non-limiting and provided for illustrative purposes only.

When top bar 104 bottom bar 106, first side bar 108, and second side bar 110 are assembled, exercise device 102 defines an empty space, represented as empty space 112. Empty space 112, in this non-limiting, exemplary embodiment, is advantageously devoid of any underlying board or base. The lack of any underlying board or base assists in keeping exercise device 102 more lightweight as compared to other exercise devices that require a heavy board or platform underlying their surfaces. In one non-limiting embodiment, exercise device may weigh approximately between 6-10 lbs.

It is noted that the foregoing embodiment is not meant to preclude the possibility of having other alternative embodiments that may utilize a board or base attached to a back of exercise device 102. Further, it is noted that the exercise device 102 may also be lightweight due to the relatively thin diameters of top bar 104, bottom bar 106, first side bar 108, and second side bar 110 that may be assembled into exercise device 102.

In addition to the above described elements, exercise device 102 further includes frame handles 114. Exercise device 102 also includes three attachment points 122, 123, and 125. A first frame handle 114 is affixed to first side bar 108 and a second frame handle 114 is affixed to second side bar 110. The frame handles 114 may be identical in appearance and general size. Frame handles 114 may be rigidly affixed to first side bar 108 and second side bar 110 in one non-limiting embodiment. In other alternative embodiments, frame handles 114 may be removeably attached and it may even be possible to attach each frame handle 114 to other parts of exercise device 102 if a user wanted to move the position and placement of frame handles 114 for any reason.

However, in the embodiment shown in FIG. 1, frame handles 114 are affixed substantially to an upper portion of first side bar 108 and second side bar 110. Frame handles 114 may each include a top portion 116 and a base portion 118. In one non-limiting embodiment, the distance 146, which may reflect the distance from a top end of first side bar 108 and second side bar 110 to the beginning of base portion 118, may be approximately 5.87 inches. Further, the distance 148, which may reflect the distance from a top end of first side bar 108 and second side bar 110 to the beginning of the attachment point affixed to the top surface of the first side bar 108 (i.e. attachment point 122) and the attachment point affixed to the top surface of the second side bar 110 (i.e. attachment point 123) may be approximately 8.87 inches. Those of ordinary skill in the art will appreciate that the components listed above may be designed having other dimensions and measurements without departing from the scope of this invention, and that these dimensions and measurements as described herein and throughout the present description are all non-limiting and provided for illustrative purposes only.

The frame handles 114 may be covered by a cushioned element, such as cushioned element 154. In one or more non-limiting embodiments, cushioned element 154 may be EPDM rubber, which may help to reduce any pressure on the user's hands and joints when a user grasps frame handles 114. The cushioned element 154 may extend from the base portion 118 up to the top portion 116 of frame handles 114 or may only be wrapped around top portion 116 in alternative embodiments.

As shown in FIG. 1, top portion 116 of frame handles 114 may be angled outwardly and protrude in an angled direction, while base portion 114 may extend straight upward until top portion 116 begins to angle away. In one or more non-limiting embodiments, an angle 160 between a top surface of first side bar 108 and second side bar 110 may be approximately 30 degrees, although those of ordinary skill in the art will appreciate that various other angles may be used in alternative embodiments. Without precluding the possibility of using a variety of angles for frame handles 114, it has been found through experimental use that this angle of 30 degrees or thereabouts may be a particularly preferable angle for a user to comfortably grasp and hold frame handles 114 when performing one or more exercises.

Continuing with the elements included with exercise device 102, attachment points 122, 123, and 125 are ring like elements that are distributed on one or more bars of exercise device 102. Attachment points 122, 123, and 125 may be rigidly affixed (e.g. permanently affixed) to a top surface of any of the bars (e.g. 104-110) of exercise device 102. As shown in FIG. 1, there are at least three attachment points affixed to exercise device 102, although a greater or lesser number of attachment points may be included in alternative embodiments of exercise device 102.

The first attachment point 122 is located on first side bar 108. The second attachment point 123 is located on the second side bar 110, while the third attachment point 125 is located on the bottom bar 106. Each attachment point 122, 123, and 125 may be substantially identical in appearance. As shown in FIG. 1, attachment points 122, 123, and 125 are generally C-shaped, or are semi-circular in shape and include an aperture 162. In alternative embodiments, attachment points 122, 123, and 125 may be other shapes and configurations as known in the art, including without limitation, U-bolts, O rings, and/or D rings.

With respect to the third attachment point 125, attachment point 125 is substantially centrally located on bottom bar 106. In one non-limiting embodiment, distance 150, which may refer to a distance from an end of bottom bar 106 to a beginning of attachment point 125, may be approximately 11.56 inches.

Attachment points 122, 123, and 125 may angle inwardly in one or more non-limiting embodiments, although in alternative embodiments attachment points 122, 123, and 125 may point straight up and/or angle outwardly in various configurations. Further, a width 152 of attachment points 122, 123, and 125 may be approximately 1.38 inches in one or more non-limiting embodiments.

Figure 2:
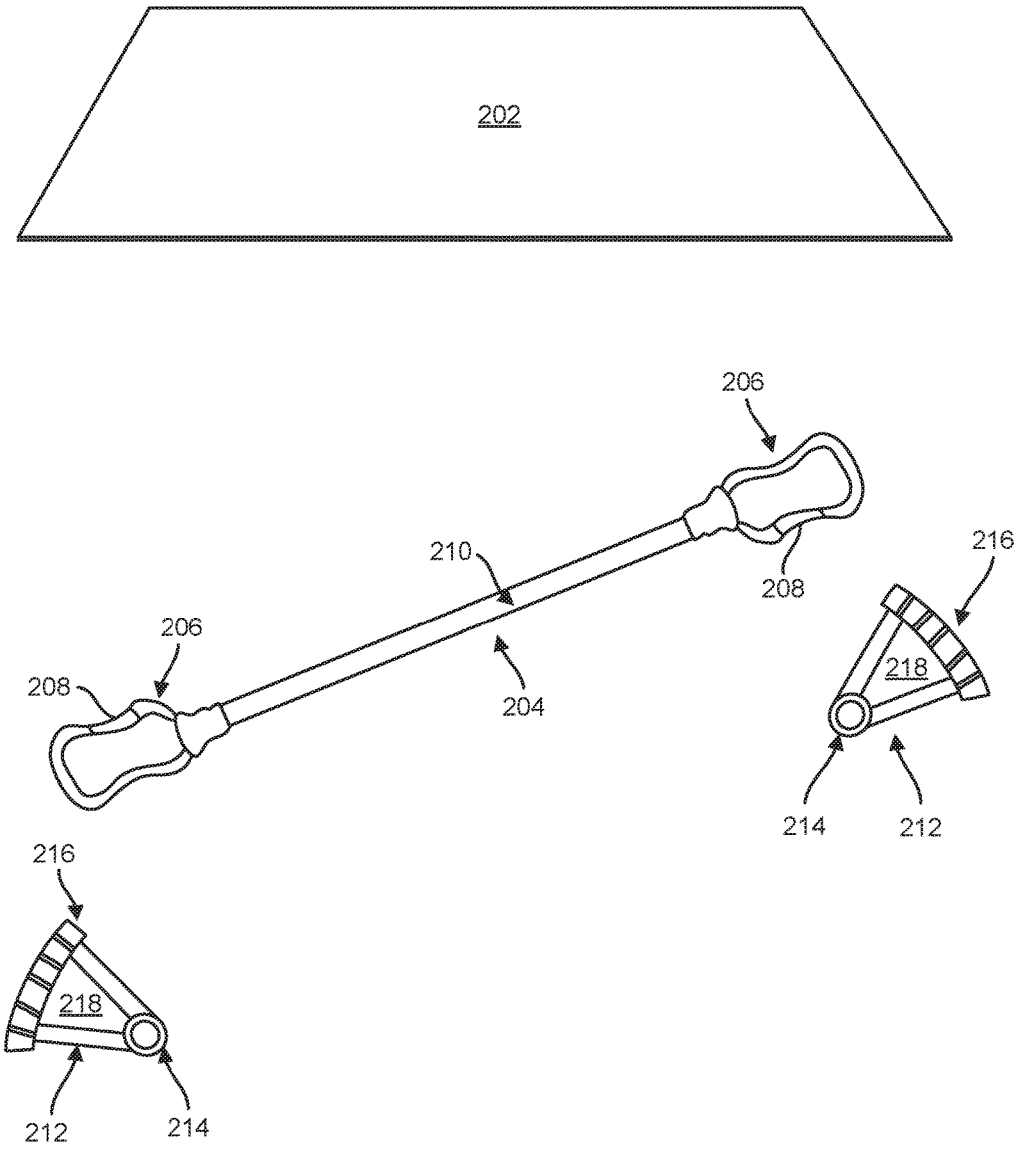
FIG. 2 is a pictorial view of components to accompany an exercise device, including a set of resistance bands and resistance band handles in accordance with one or more illustrative embodiments.

Attachment points 122, 123, and 125 are configured to provide a fixed element on the exercise frame 102 to which a user can clip or fasten one or more resistance bands (e.g. resistance band 204 as shown in FIG. 2). The attachment points 122, 123, and 125 thus are configured to provide an element for removably attaching one or more resistance bands to be used during the performance of exercises.

In one or more non-limiting embodiments, top bar 104, bottom bar 106, first side bar 108, second side bar 110, the frame handles 114 (excluding the cushioned element 154), and the attachment points 122, 123, and 125 may all be manufactured from a durable metal, such as steel. In particular, low carbon cold rolled steel may be particularly well suited for these components of exercise device. Nevertheless, those of ordinary skill in the art will appreciate that alternative materials may be used to manufacture these various components of exercise device 102 including alternative metals, plastics, and/or a combination thereof, without limitation herein to the materials described above.

Turning to FIG. 2, FIG. 2 illustrates other items or accessories that may be used in conjunction with exercise device 102 by a user who is performing a variety of exercises. Mat 202 is an example of a mat that may be placed beneath exercise device 102. Mat 202 may be any type of mat known in the art, including mats commonly referred to as "yoga mats." Mat 202 has a cushioned surface and a minimal level of thickness to provide cushioning and comfort to a user that is either standing, kneeling, in a bent, or seated position on the surface of mat 202 while using exercise device 102. It is noted that it is optional for user to utilize a mat, such as mat 202. A user may instead select to position exercise device 102 on any type of working surface, including, without limitation, hard wood floors, concrete, carpet, grass, sand, or any other type of suitable surface on which a user chooses to train.

Resistance band 204 may be a resistance band as understood by those of ordinary skill in the art, which is a band that provides a weight and level of resistance for a user to use while resistance training. Resistance band 204 may include a protective cover, such as cover 210, that extends over the length and the ends of resistance band 204. Resistance band 204 may be made of a resilient, flexible and extendable material that is configured to extend beyond its original length and to return to its original length when not being pulled or pushed. Resistance band 205 may be able to extend anywhere from 2 to 4 times (for example only) its original length in one or more embodiments. Resistance band 204 may be manufactured from any type of suitable material known in the art.

Clips 206 are attached or otherwise connected to each end of resistance band 204. In one or more non-limiting embodiments, clips 206 may be made of metal, plastic, or a combination thereof. In one non-limiting embodiment, each resistance band 204 may weigh approximately six pounds (lbs.) in weight, which means that resistance band 204 is the equivalent of carrying or holding six pounds of weight. Further, for example purposes only, a user may purchase or otherwise obtain a set of six (or more or less) at one time to utilize with exercise frame 102. Those of ordinary skill in the art will appreciate that resistance band 204 may be any number of pounds in alternative configurations.

One benefit of resistance bands 204 is that they may be connected from either end to various elements (e.g. to attachment points 122-125 or to resistance band handles 212) using clips 206 or other fastener elements or other means of attachment. As part of the overall system of components associated with exercise device 102, there may be separate resistance band handles, such as resistance band handles 212 as shown in FIG. 2. Resistance band handles 212 may be removeably attached to clips 206 of resistance band 204. Clips 206 each include a clip element 208 that opens and closes and is attached to the remainder of the body of clip 206. In some embodiments, clip element 208 may be opened and then the remainder of clip 206 may be hooked over the ring 214 (or similar element) of resistance band handles 212, thereby attaching the resistance band 204 to the resistance band handle 212. In one or more non-limiting embodiments, ring 214 of resistance band handle 212 may be an O-ring, a D-ring, or any other type of ring suitable for connecting to other elements, such as clip 206. Thus, in some embodiments, each resistance band handle 212 includes a cushioned gripping element 216, an opening 218, and short straps that connect cushioned gripping element 216 to a ring, such as ring 214.

As further shown in FIGS. 5-14 and described later below, for some exercises, a user may select to attach one resistance band handle 212 to one end of resistance band 204, and then to clip the other end of the resistance band 204 to an attachment point of exercise device 102, such as any of attachment points 122, 123, or 125. Resistance band handles 212 may further include a cushioned element 216 on a top portion of resistance band handles 212 that may have a foam or other type of cushioning to reduce the stress and discomfort on a user's hand or foot when a user goes to utilize resistance band handles 212 for training purposes. Thus, a user is able to utilize resistance band handle 212 for inserting his or her hand or foot into the opening 218 of resistance handle 212.

Figure 8:
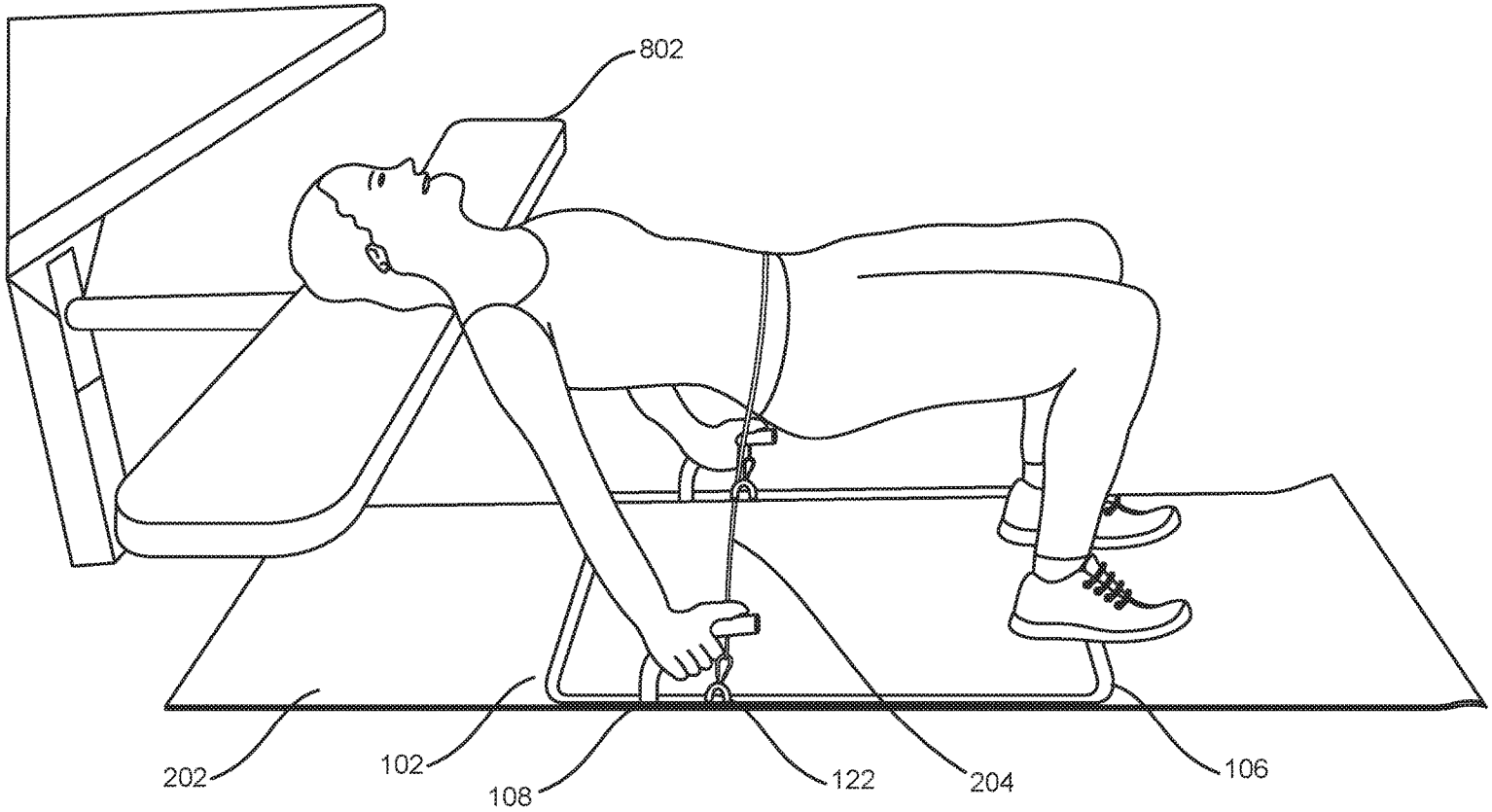
FIG. 8 is a pictorial illustration of an exercise referred to as "Hip Thrusts" which a user may perform using an exercise device in accordance with one or more illustrative embodiments.
Figure 13:
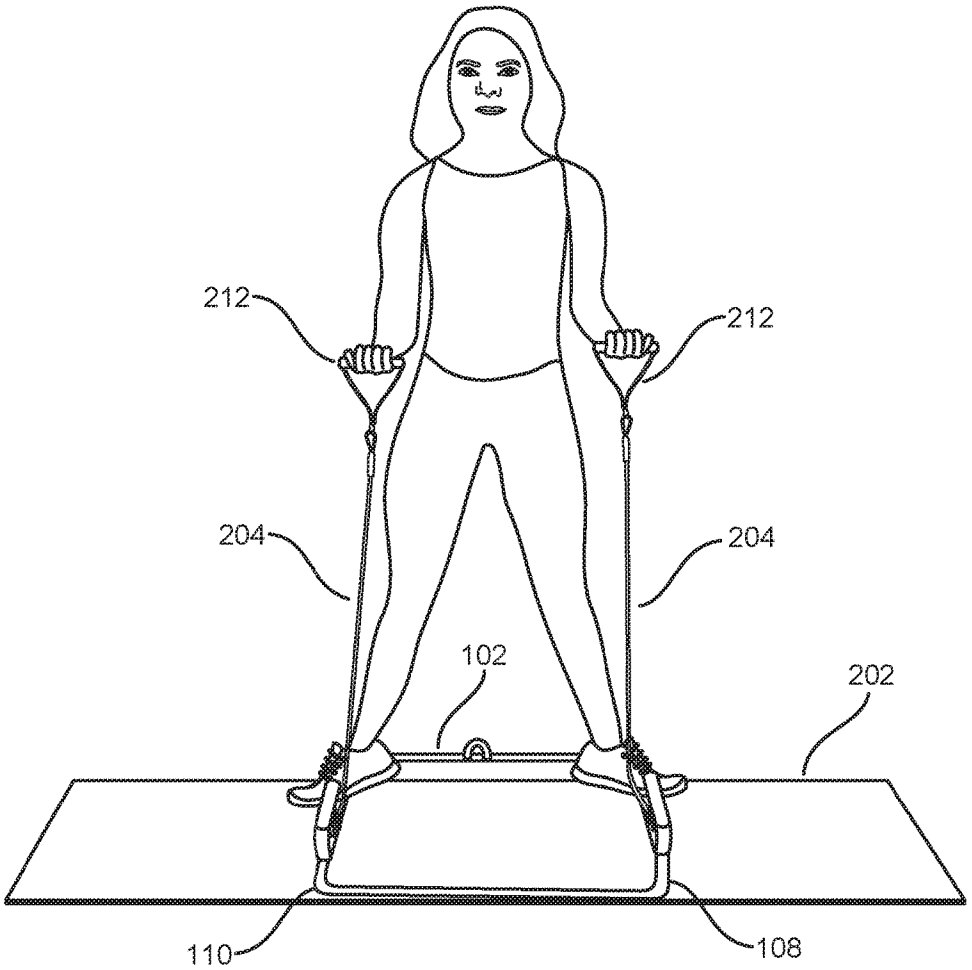
FIG. 13 is a pictorial illustration of an exercise referred to as "Bicep Extensions" which a user may perform using an exercise device in accordance with one or more illustrative embodiments.

Beneficially, a user is able to increase the level of challenge and difficulty for any exercise being performing by adding additional resistance bands 204. Accordingly, to increase the difficulty of one's resistance training, a user may choose to clip anywhere from two, three, four, or more resistance bands to attachment points 122, 123, or 125 depending on the strength capabilities and stamina of the user and what he or she is trying to achieve. Accordingly, resistance bands 204 may be used to clip either or both sides to an attachment point (e.g. 122, 123, 125) without any resistance handles (e.g. as shown in FIG. 8 illustrating performing "Hip Thrusts") on exercise device 102. Alternatively, the user is able to clip one end of resistance band 204 to an attachment point of exercise device 102 and the other end of the resistance band 204 to a resistance band hand, such as resistance band handle 212 (e.g. as shown in FIG. 13 illustrating performing "Bicep Extensions.")

Figure 3:
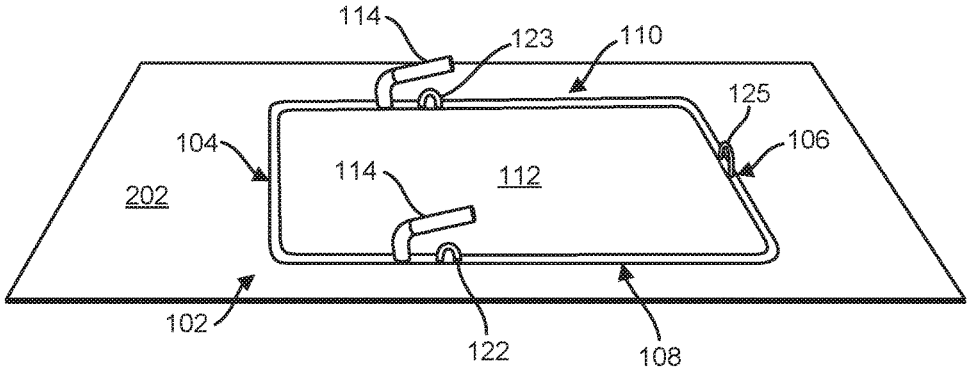
FIG. 3 is a pictorial view of the exercise device in a horizontal orientation in accordance with one or more illustrative embodiments.

Turning to FIG. 3, FIG. 3 illustrates a pictorial illustration of exercise device 102 oriented in a horizontal direction, whereby exercise device 102 is placed flat on the top surface of mat 202. Exercise device 102 may be laid in this configuration when a user wants to perform any of the various exercises that allow for a user to lay exercise device 102 flat against mat 202 (or other working surface including a ground surface, carpet, hard wood floors, etc.). Examples of such exercises a user may perform while exercise device 102 is in a horizontally flat position include, without limitation thereto, push-ups, planks, deltoid extensions, bicep extensions, triceps dips, bent over rows, kneeling donkey kicks, and squats. Such exercises as listed herein are for illustrative purposes only and are not meant to be restrictive.

Figure 4:
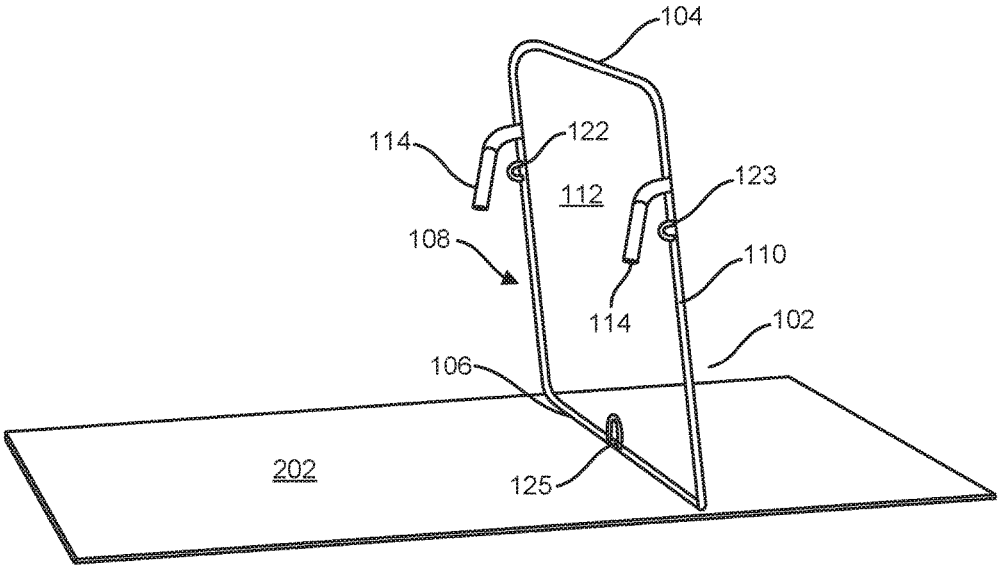
FIG. 4 is a pictorial view of the exercise device in an upright, vertical orientation in accordance with one or more illustrative embodiments.
Figure 5:
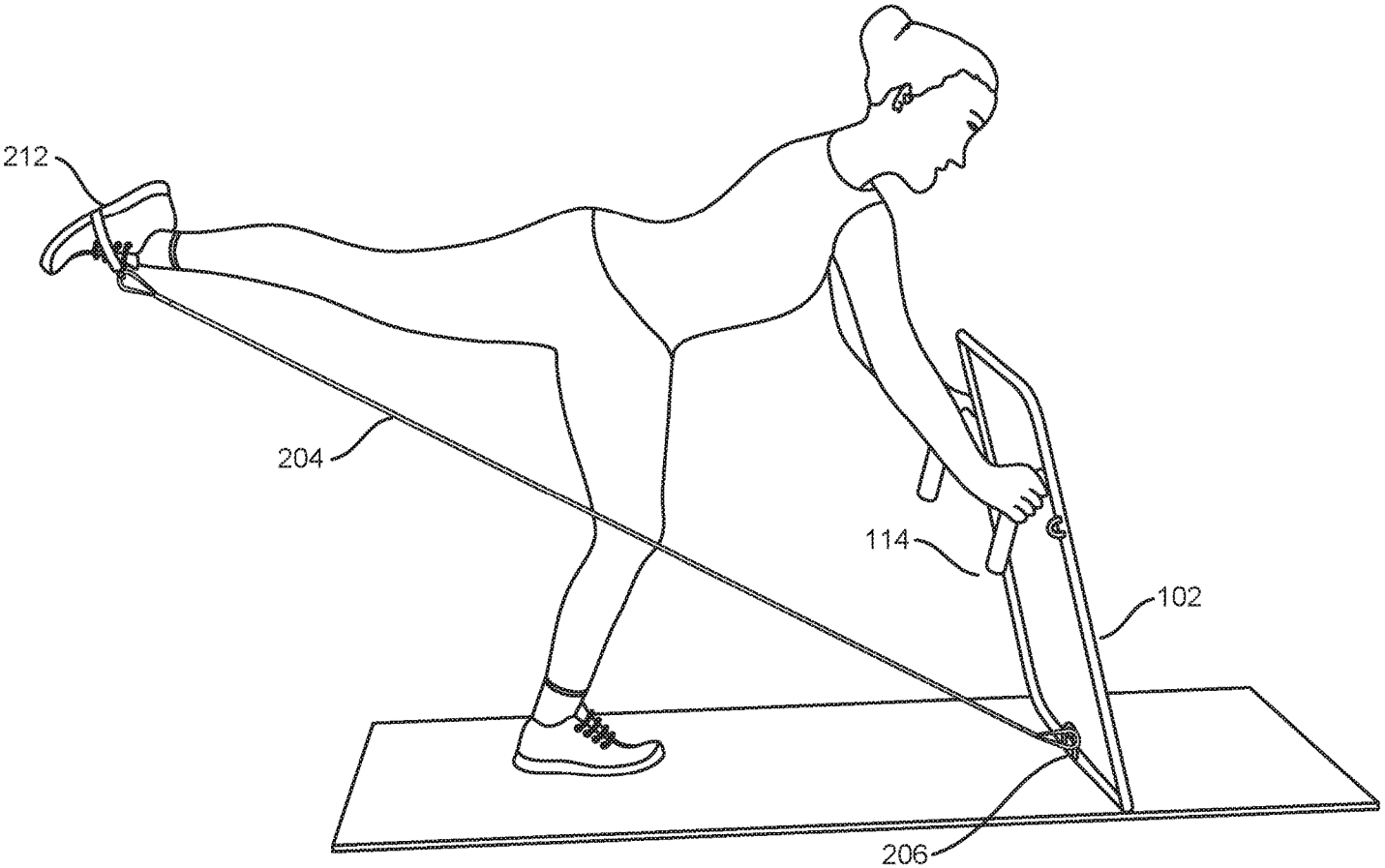
FIG. 5 is a pictorial illustration of an exercise referred to as "Standing Donkey Kicks" which a user may perform using an exercise device in accordance with one or more illustrative embodiments.
Figure 6:
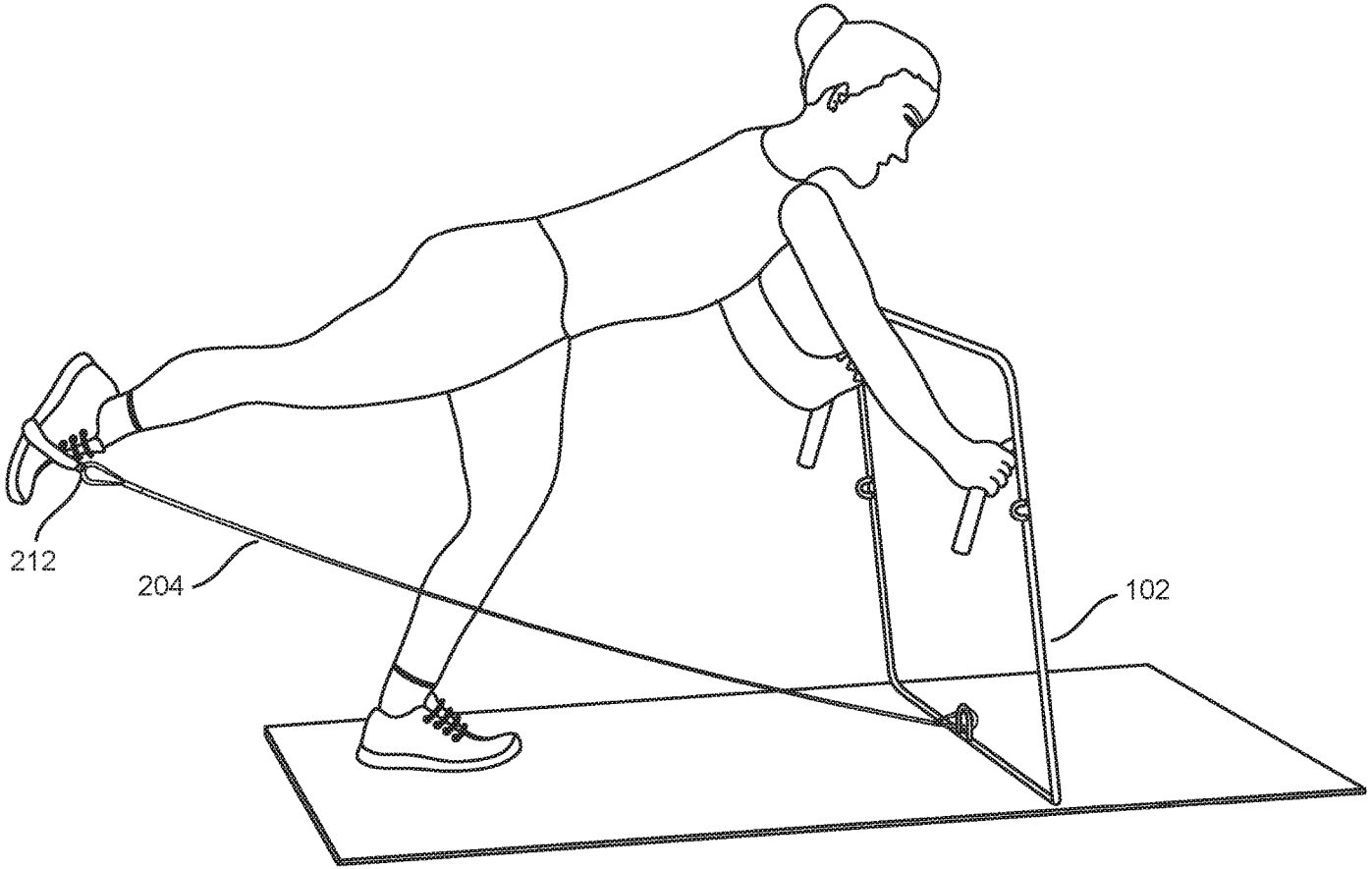
FIG. 6 is a pictorial illustration of an exercised referred to as "Standing Half Circles" which a user may perform using an exercise device in accordance with one or more illustrative embodiments.
Figure 7:
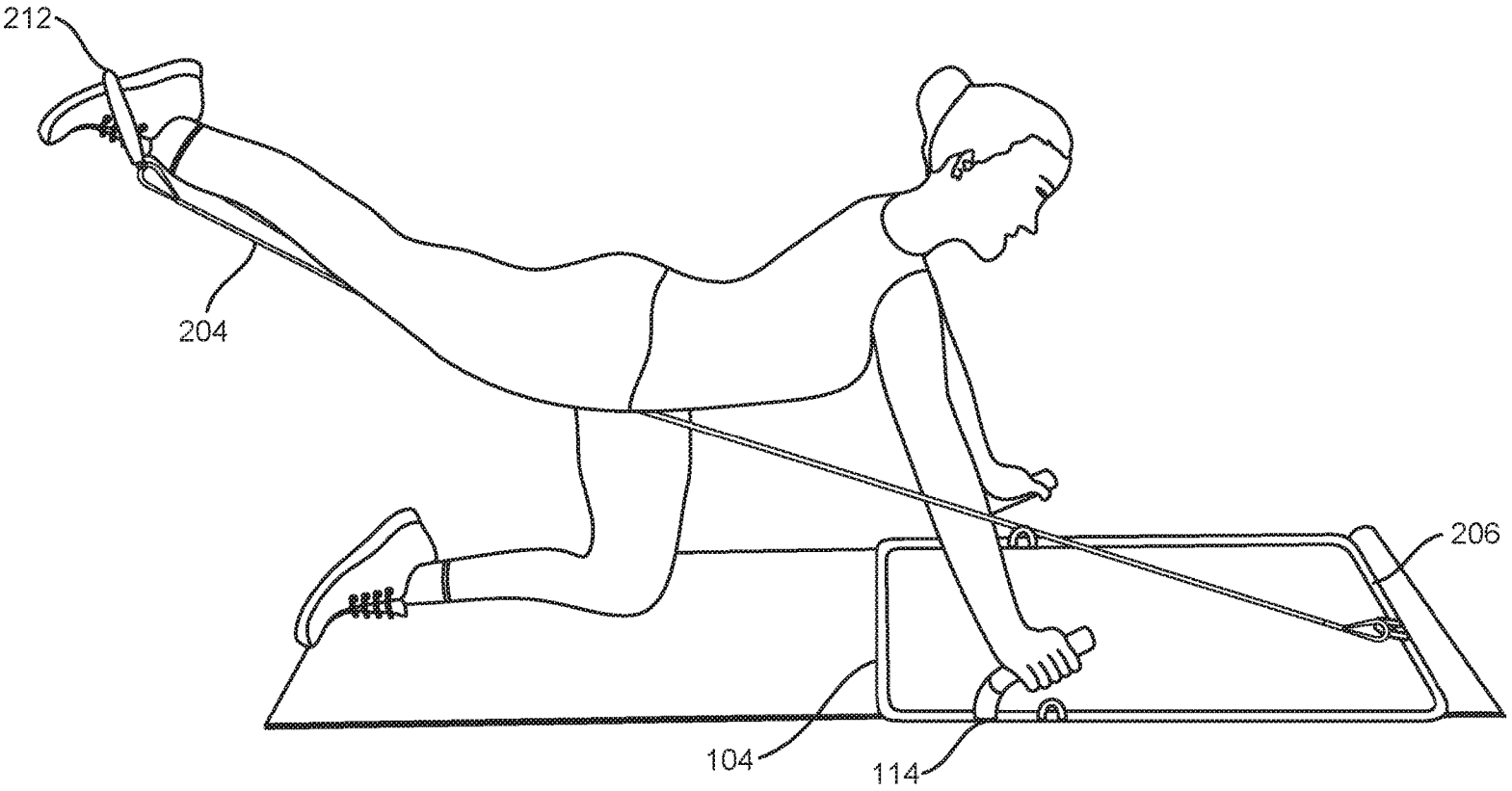
FIG. 7 is a pictorial illustration of an exercise referred to as "Kneeling Donkey Kicks" which a user may perform using an exercise device in accordance with one or more illustrative embodiments.

FIG. 4 shows a pictorial illustration of exercise device 102 in an upright, generally vertical orientation. Advantageously, one of the many benefits of exercise device 102 is the ability to perform a wide variety of resistance training type exercises in a way that targets certain muscles and works different facets of one's muscles. By being able to position exercise device 102 in an upright position as shown in FIG. 4, there are a variety of exercises that may be performed whose level of difficulty are a challenge to a user and help to develop their muscles even further, including many exercises that specifically target the muscles of the legs and gluteal region of the body (e.g. as shown in FIGS. 5-7) and described below. Frame handles 114 on each lateral side of exercise device 102 are configured so that a user may grasp each frame handle 114 and hold exercise device 102 upright while performing various exercises such that bottom bar 106 of exercise device 102 is flat against mat 202 (or any other type of working surface).

In some cases (depending on the overall height of the user) a user is likely to need to bend over to some degree while grasping both handles and while also performing an exercise using a resistance handle attached to one's foot (for example). The bent over position while the user is grasping the exercise device handles 114 can be beneficial to a user's workout, because this requires the user to work their upper body muscles in their back, shoulders, and arms, as well as their abdominal muscles to stay balanced.

Further, it is noted that one of the many benefits of exercise device 102 is the ability for a user to focus and tone the muscles in the gluteal region of a user (or a rear end of a user). Examples of exercises that may be performed using exercise device 102 in an upright position as shown in FIG. 4 may include, without limitation thereto, standing half circle leg extensions, standing donkey kicks, standing side kicks, and kneeling side kicks. Additional exercises may also he performable while exercise device 102 is positioned in this upright position, as the list provided above is not meant to be restrictive, but rather illustrative and exemplary in nature.

The exercises listed above, namely standing half circle leg extensions, standing donkey kicks, standing side kicks, and kneeling side kicks, are particularly adept at toning and strengthening the muscles of the gluteal region in a way that other work out devices are unable to do, as well as the entire group of muscles on a user's leg.

Nevertheless, it is noted that exercise device 102 (in combination with resistance bands 204 and resistance band handles 204) are useful in working out the muscles of the entire body without being limited only to the muscles of any particular region. By using the exercise device 102 as provided herein, it is possible to strength, tone, and develop one's muscles, without limitation thereto, in one's shoulders, back, triceps, deltoids, biceps, abdominals, legs, gluteus, and calves.

FIGS. 5-14 illustrate a variety of exercises that may be performed using a combination of exercise device 102, resistance bands 204, resistance band handles 212. In some cases, a user may also utilize a mat, such as mat 202 (which may be substituted with any type of working surface). FIGS. 5-15 illustrate how versatile exercise device 102 is, because this frame with the frame handles 114 may be oriented or positioned in a horizontal or an upright position so that a user can perform any exercise the user desires.

FIG. 5 illustrates an exercise referred to as "Standing Donkey Kicks." In FIG. 5, the user is shown gripping both handles 114 on exercise device 102. FIG. 5 shows the user in mid-exercise with one of the user's leg extended behind the user, and the other placed firmly on the ground for balance. To perform this exercise, the user connects a resistance band, such as resistance band 204 using clip 206 to clip onto attachment point 125 of exercise device 102. Attachment point 125 is the attachment point that is substantially centrally located on bottom bar 106 of exercise device 102. At the other end of resistance band 204, the second clip 206 is clipped onto resistance band handle 212 via clip 206 (or other attachment mechanisms) to the ring 214 on the resistance handle 212. Once resistance band 204 is attached to exercise device 102 with the resistance handle 212, a user is able to insert one foot into the opening 218 of resistance handle 212.

Subsequently, a user may grasp both handles 114 of exercise device 102 such that exercise device 102 is oriented in an upright position so that a bottom surface of bottom bar 106 of exercise device 102 is in contact with a working surface (e.g. mat 202). This exercise shown in FIG. 5 (referred to as Standing Donkey Kicks) is known for being particularly beneficial for toning and strengthening the muscles of the legs and the gluteal region, including for both the leg that is extended backwards and forwards, and also for the leg that is used to balance in place. The act of balancing on one leg while also supporting the exercise device 102 means that substantially all of the user's muscles are engaged in the resistance training, because a user has to support him or herself upright while leaning over. This exercise further engages the back muscles as well as the abdominal muscles, and the muscles in the arms to some degree.

It is noted that the focus of this exercise is to develop and tone the muscles of the gluteal region and the legs, but advantageously other muscles may be worked on and developed simultaneously. It is noted that as with any of the exercises the user may choose to increase the level of difficulty and challenge of the exercise by clipping additional resistance bands to an attachment point (e.g. attachment point 125) of exercise device 102 at one end and also clipping the additional resistance bands at the other end to the ring 214 of one resistance handle 212. In one non-limiting embodiment, each resistance band may be at least six pounds, so adding even one extra resistance band may bring the total weight on that extended leg to at least twelve pounds, which is challenging for most people.

Beneficially, exercise device 102 is challenging to athletes and workout enthusiasts of various fitness levels, and it is always possible to increase the resistance by adding more resistance bands and/or adding heavier resistance bands. Additionally, a user may choose to perform any number of repetitions and sets to challenge himself or herself. Further, once the user has completed the desired number of repetitions on one leg, the user may switch legs by simply inserting the foot of the other leg into the opening 218 of the resistance band handle 212 and begin the same exercise using the other leg that was previously acting as the balancing leg.

Additionally, it is noted that for many other exercises that are performable using the exercise device 102 that multiple muscles are required to work "against" each other, which thereby strengthens and tones the engaged muscles more than regular resistance training. For example, with most weight lifting machines, the user is only able to work one or two muscles using the weight lifting machine, and the weight lifting machine holds the weight of the machine. In contrast, when exercising utilizing exercise device 102 the user has to perform an exercise (e.g. Standing Donkey Kicks shown in FIG. 5, Standing Half Circles shown in FIG. 6, and Hip Thrusts shown in FIG. 8) balancing using his or her muscles and also preventing the exercise device 102 from moving out of place. This causes the muscles to work in opposition to one another and challenges the muscles more than traditional resistance based exercise tools.

Turning to FIG. 6, FIG. 6 shows an exercise known as "Standing Half Circles." In this exercise, the user is standing in a similar position to the "Standing Donkey Kicks" exercise shown in FIG. 5. As shown in FIG. 6, the user is gripping each frame handle 114 with each hand after having clipped (e.g. via clip 206) one end of resistance band 204 to attachment point 125 on exercise device 102 and then clipping the other end of resistance band 204 to resistance handle 212. After the user selects which foot to insert into the opening 218 of resistance handle 212, the user may then balance on one leg, and begin sweeping the leg with the inserted foot in resistance handle 212 from side to side behind the user in a general circular motion. The resistance band 204 offers resistance as the user performs these exercises and will cause the user to have to exert effort using his or her muscles. Both of the exercises demonstrated in FIG. 5 and FIG. 6 illustrate a unique advantage of exercise device 102, which is that a user is able to perform difficult and effective exercises to target specific areas of the leg and gluteal region while standing and holding the exercise device 102 in a upright position via frame handles 114.

Turning to FIG. 7, FIG. 7 shows an exercise referred to as "Kneeling Donkey Kicks." FIG. 7 shows how exercise device 102 is also useful when oriented in a horizontal position with the user supporting his or her weight by grasping frame handles 114 with the user's hands positioned around the angled inclined top portion 116 of frame handles 114.

In FIG. 7, the exercise may be performed by orienting or positioning exercise frame 102 flat against a surface, such as mat 202 or any other surface as desired. In this horizontal position, the rear side of exercise frame 102 is in contact with the surface and the frame handles 114 are pointing upwards as opposed to in a downwards direction as shown in FIGS. 5-6.

The user may clip via clip 206 resistance band 204 to an attachment point, such as attachment point 125 on bottom bar 106. The user may clip the second clip 206 on the other end of the resistance band 204 to the ring 214 of resistance band handle 212. The user may then insert one foot of a desired workout leg into the opening 218 of resistance handle 212. Next, the user may grasp each frame handle 114 and lean over while on one knee so that the user's body is directly over the frame handles 114 (with the top bar 104 closest to the body of the user). The user can still support himself or herself upright by holding the frame handles 114. Subsequently, the user may extend the leg with the foot that is inserted into the resistance band handle 212 straight out directly behind the user and then return the leg to the bent position. To perform this exercise, the user continuously does this motion back and forth with this leg until the user has completed the desired number of repetitions and sets. Accordingly, FIG. 7 shows an example of an exercise that may be accomplished while the user is kneeling and using exercise device 102. Further, this exercise is multi-purpose, because the muscles of the legs and gluteal muscles are worked and developed, but the muscles of the back, arms, shoulder, and abdominals are also toned and challenged because the user is still supporting themselves on the frame handles 114 of exercise device 102. It is noted that these exercises are particularly useful for targeting multiple muscle groups and body parts at once, which provides for a more efficient and effective overall workout for a user.

FIG. 8 shows an exercise referred to as "Hip Thrusts." This exercise may be performed by balancing the back and/or shoulders against a bench, such as bench 802 or any type of suitable support surface, including, without limitation, a couch, a chair, a bed, or any suitable support surface. Hip Thrusts are performed to develop, tone, and strengthen the gluteal muscles, as well as the muscles in the legs and the lower abdominals to some degree.

To perform this exercise shown in FIG. 8, a user may orient the exercise device 102 in a horizontal position, such that the rear side of the exercise device 102 is in contact with a ground or other workout surface and the frame handles 114 are pointing upwardly. The user may sit down and place his or her feet on the bottom bar 106 of the exercise device 102. Subsequently, the user may selectively attach one or more resistance bands 204 to attachment point 123 on second side bar 110 and then cross the resistance bands 204 over the user's body in order to connect the other connector end of the resistance bands to attachment point 122 on first side bar 108.

Each user may determine the level of challenge that is suitable for the user, and in some cases, the user may choose not to attach any resistance bands 204 that extend over his or her abdominals and legs, because the Hip Thrusts exercises may be difficult enough to perform for the user without additional resistance from the resistance bands 204.

In an initial position, the back of the user is supported at an angle by the support surface 802 and the user is seated. To engage his or her muscles, the user pushes upwardly while grasping the frame handles 114 and continues with this motion repeatedly. Thus, the user pushes his or her hips upwardly and downwardly until the user has completed the number of desired repetitions. Having the additional resistance bands 204 crossed over the front of the user while the user pushes upwards adds a challenge to the user and helps in strengthening his or her muscles. Further, this exercise shown in FIG. 8 is particularly useful in developing the muscles in the arms, including triceps which help to support the user in the extended, upward position and to keep the exercise device 102 in place against the ground surface.

The Hip Thrusts exercise is one of the most effective exercises in terms of building and toning the muscles, because the user has to both raise and lower his or her hips, thus working the entire lower body. In addition to raising and lowering his or her hips, the user must also exert a downward force on the exercise device 102 to prevent the exercise device 102 from lifting off of the ground, which also works the user's upper body muscles, including shoulders and arms. As discussed above, the user's muscles are working against each other or in opposition to one another and thus the Hip Thrusts exercise provides an appropriate level of challenge and difficulty for those users trying to build and tone these muscles.

Figure 9:
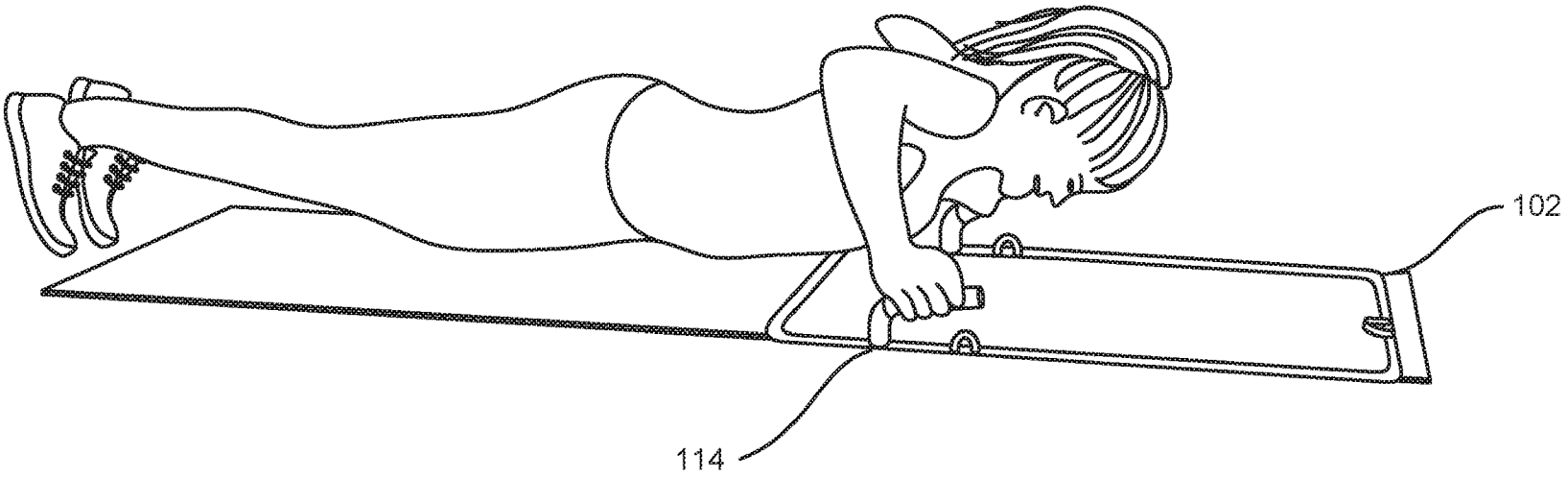
FIG. 9 is a pictorial illustration of an exercise referred to as "Push-ups" which a user may perform using an exercise device in accordance with one or more illustrative embodiments.

Turning to FIG. 9, FIG. 9 shows how a user may perform "Push-Ups" using exercise frame 102. The user may orient exercise device 102 such that the exercise device is flat against a working surface and the firm handles 114 are pointing upwardly. The user may then position their body over frame handles 114 while holding onto frame handles 114. The user may then extend their legs behind them and begin to raise and lower themselves by pushing upwards with their arms while gripping the frame handles 114 and then bending their arms to lower their body over the exercise device 102, thus performing a series of push-ups. The user may choose to do as many push ups as he or she is able. A modification of this exercise would allow for a user to perform push ups with both knees against the ground or other workout surface rather than extending their body in an extended, plank position while performing the push-ups, which should reduce the difficulty slightly of the exercise. Push-ups, as shown in FIG. 9, are often recommended as being a great exercise to develop and strengthen the user's back and shoulder muscles, but many people complain about having wrist pain or should pain while performing this exercise. Advantageously, because exercise device 102 is designed as described in the present description and includes frame handles 114 which may include cushioned element 154 (e.g. which may be made of EPDM rubber), the strain and pressure on a user's wrists and back is reduced, thus allowing the user to perform push-ups or similar exercises with greater ease and comfort.

Figure 10:
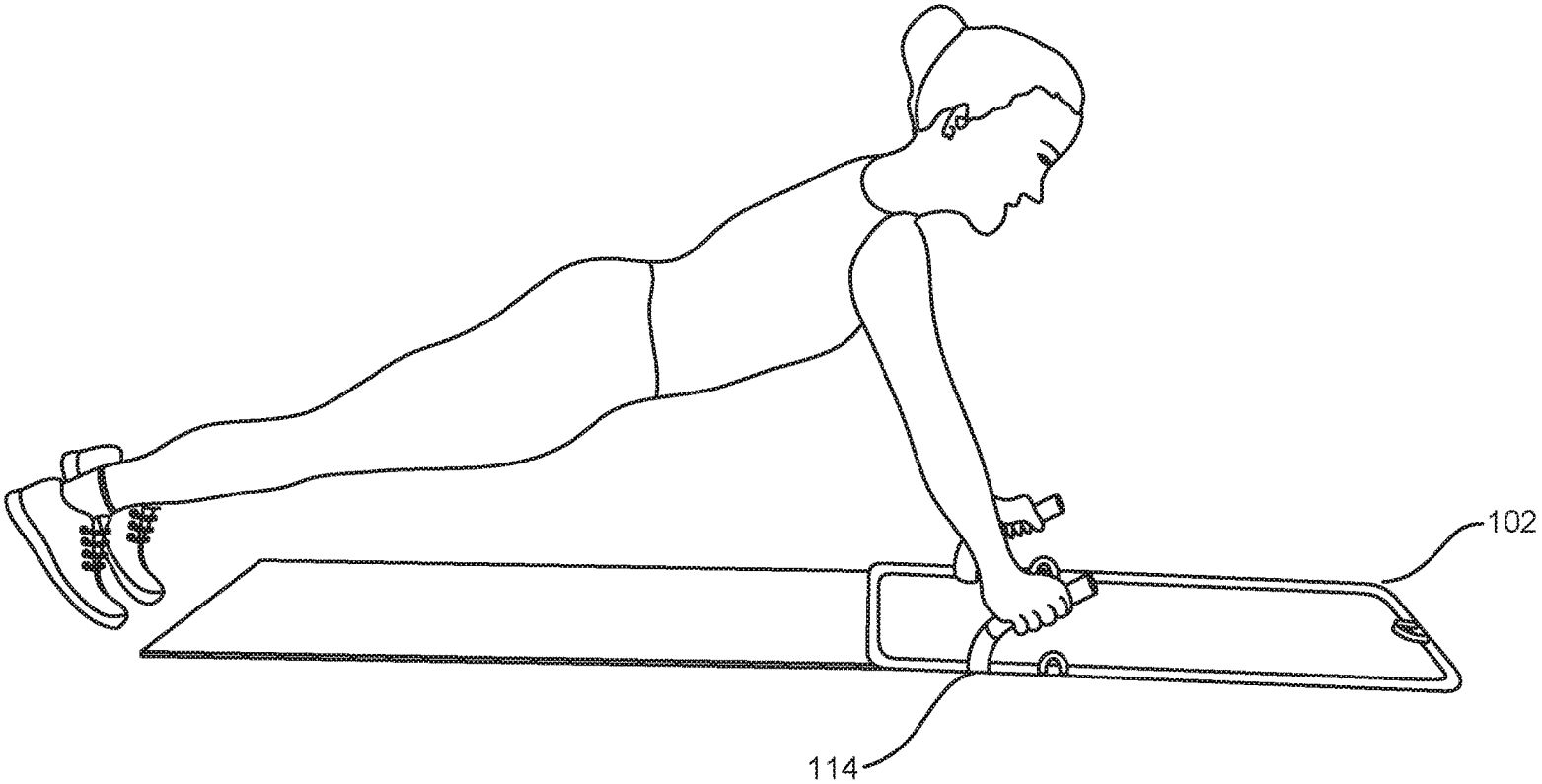
FIG. 10 is a pictorial illustration of an exercise referred to as "Planks" which a user may perform using an exercise device in accordance with one or more illustrative embodiments.

Turning to FIG. 10, FIG. 10 shows a user engaged in performing "Planks" using exercise device 102. Similar to performing a push-up as shown in FIG. 9, exercise device 102 may be positioned horizontally flat against a working surface. The user may position himself over frame handles 114 holding onto the top portion 116 of frame handles 114 with both hands as user's body is positioned over frame handles 114 and top bar 104. The user may extend his or her body behind and support their body for as long as possible in this position while pushing their body upwardly and gripping the frame handles 114. With planks, the objective of the exercise is to attempt to hold oneself in this position for a number of seconds, which challenges the core stomach muscles, arms, backs, and whole body. Planks are another type of exercise that is highly recommended for individuals who want to tone and strengthen their muscles.

Figure 11:
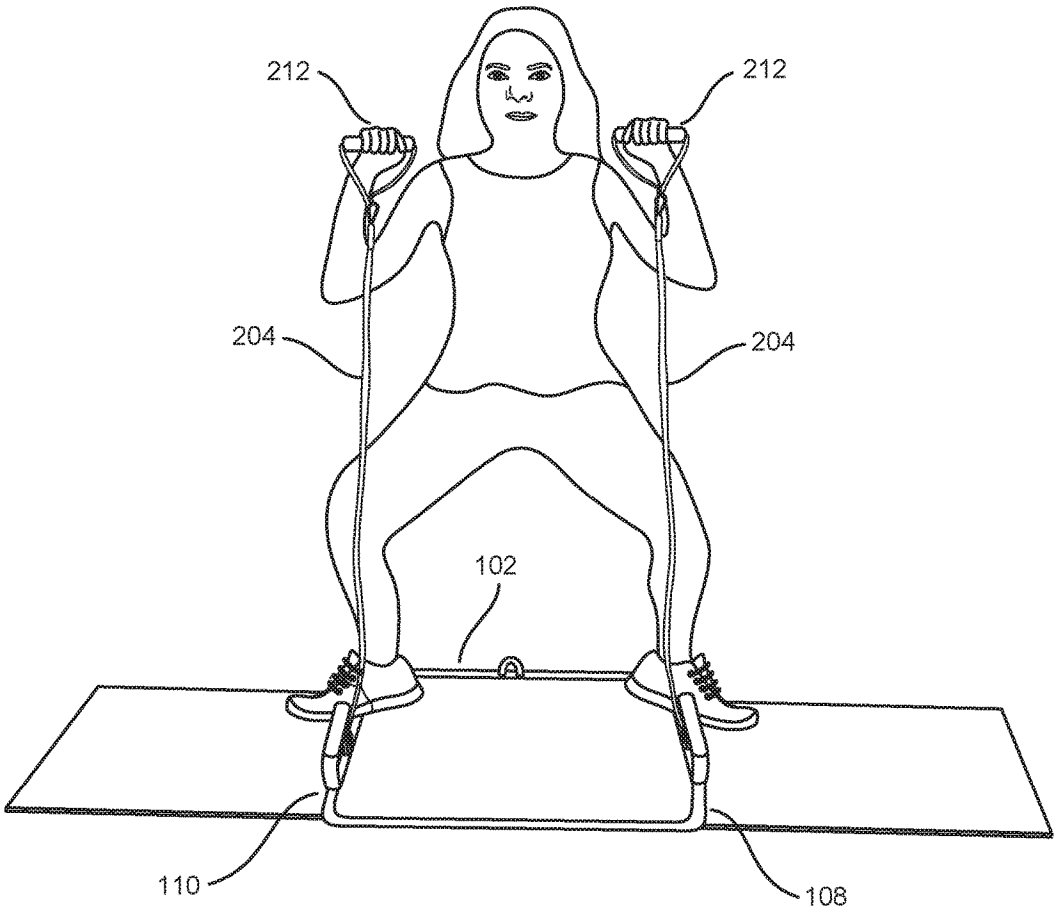
FIG. 11 is a pictorial illustration of an exercise referred to as "Squats" which a user may perform using an exercise device in accordance with one or more illustrative embodiments.

Turning to FIG. 11, FIG. 11 shows how exercise device 102 may be used to perform "Squats". To perform squats, a user may position exercise device 102 in a horizontally flat position against a working surface (e.g. mat 202 or the like). The user may attach a resistance band 204 to first attachment point 122 on first side bar 108 and may attach a second resistance band 204 to second attachment point 123 on second side bar 110 of exercise device 102. Subsequently, a user may attach (e.g. via clip 206) the other end of each resistance band 204 to each resistance band handle 212. The user is in a standing position when performing squats. The user may step on or place one foot on first side bar 108 and then place the other foot on second side bar 110. Next, the user may grasp each resistance handle 212 (while connected to resistance band 204) with each hand.

To perform a squat, the user may begin to raise and lower their body while standing on the exercise device 102 and raising and lowering the resistance bands 204 in the same direction as the user's body. The addition of the resistance bands 204 while performing squats on exercise device 102 is equivalent of raising and lowering hand weights or other weighted items and provides user with all of the same benefits from working out with hand weights. As noted above, a user may choose to increase the challenge and level of difficulty associated with this exercise by adding more than one resistance band 204 for each side and connect the multiple resistance bands 204 to the resistance band handles 212. Squats are considered a very highly effective exercise that should be incorporated regularly in people's fitness routines. Exercise device 102 allows a user to easily incorporate such exercises into their fitness routines in any location that is convenient for the user.

Figure 12:
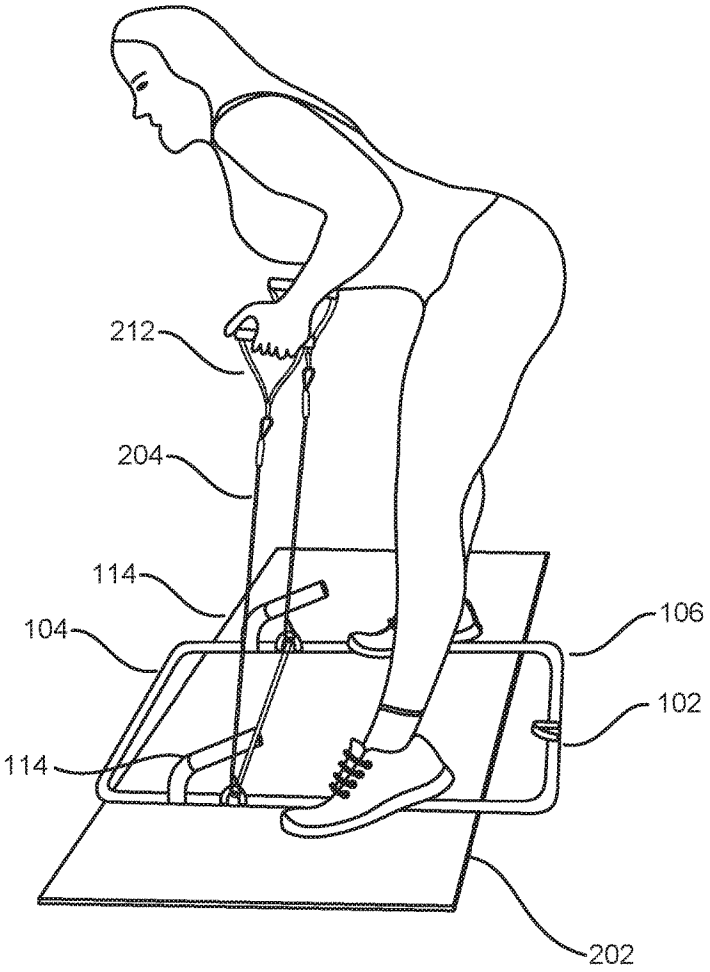
FIG. 12 is a pictorial illustration of an exercise referred to as "Bent Over Rows" which a user may perform using an exercise device in accordance with one or more illustrative embodiments.

Turning to FIG. 12, FIG. 12 shows how a user may perform an exercise referred to herein as "Bent Over Rows" using exercise device 102. The user may perform this exercise by orienting exercise device 102 flat against a workout surface in a horizontal orientation. The user may stand on the first side bar 108 with one foot and stand on the second side bar 110 with the other foot. The user is positioned behind the frame handles 114 such that the frame handles are pointing towards the user's feet. The user may attach at least one resistance band handle 204 to first attachment point 122 on first side bar 108 and to second attachment point 123 on second side bar 110, and proceed to connect the resistance bands 204 to the resistance band handles 212. To perform bent over rows, the user may then cross the resistance bands 204 in their hands, bend over, and begin to raise and lower the resistance handles without extending their arms too far upwards. This exercise may be particularly effective in working out the arms and back. Further, it is possible for the resistance bands 204 to be wrapped once or twice around the frame handles 114 so as to reduce the length of the resistance bands 204 if the resistance bands 204 are too long. Further, the act of wrapping the resistance bands 204 around the frame handles 114 also adds additional difficulty and challenge to the user's muscles. Therefore, wrapping the resistance bands 204 around the frame handles 114 may serve to shorten the length of the resistance bands 204, which may be useful for those who find the resistance bands 204 too long for their height and/or torso, as well as adding an additional level of resistance to any exercise.

Continuing to FIG. 13, FIG. 13 shows how a user may perform "Bicep Extensions" using exercise device 102. To perform bicep extensions, the user may orient the exercise device 102 in a horizontal direction flat on a working surface. The user may stand behind frame handles 114 by placing one foot on first side bar 108 and the other foot on second side bar 110. The user may have already attached one end of a resistance band to attachment point 122 and the other resistance band to attachment point 123. After the user clips on the resistance band handles 212 to the top ends of the resistance bands 204, a user may grasp the resistance band handle 212 in each hand. While standing on exercise device 102 as shown in FIG. 13, the user may proceed to raise and lower each arm to work on developing and strengthening his or her biceps. These exercises are particularly effective because a user is able to control the movement and focus on proper form. If a user wants to add to the level of difficulty and challenge, the user may add multiple resistance bands 204 while performing bicep extensions.

Figure 14:
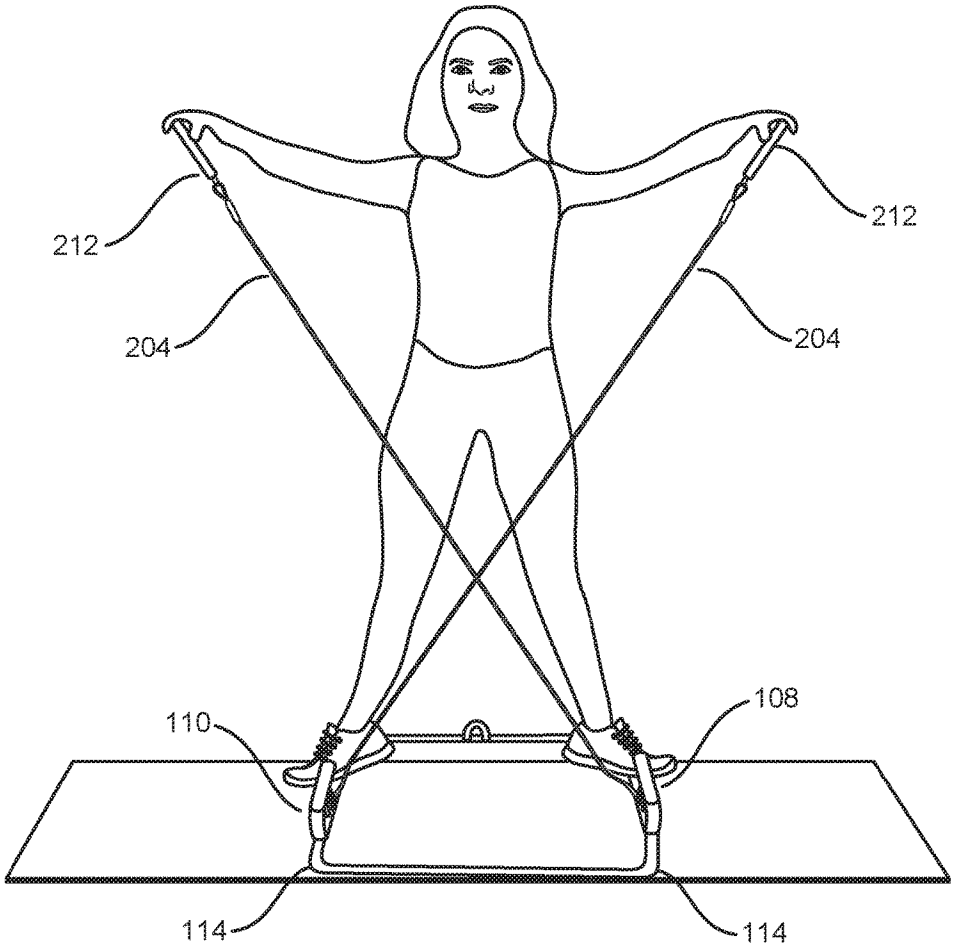
FIG. 14 is a pictorial illustration of an exercise referred to as "Deltoid Extensions" which a user may perform using an exercise device in accordance with one or more illustrative embodiments.

FIG. 14 shows how a user may perform "Deltoid Extensions" using exercise device 102. To perform deltoid extensions, the user may orient the exercise device 102 in a horizontal direction flat on the working surface. The user may stand behind the frame handles 114 by placing one foot on first side bar 108 and the other foot on second side bar 110. Subsequently, a user may attach one or more resistance bands 204 to each attachment point 122 and 123 located on first side bar 108 and second side bar 110 of exercise device 102. To perform deltoid extensions, the user may grasp the resistance band handles 212 and cross the resistance bands 204 in the front of the user's body so as to generally form the letter "x" with the resistance bands 204. Next, the user may begin to raise and lower his or her arms away from the sides of the user's body to work the deltoids.

As shown above by the exemplary images, there are numerous exercises that may be performed using exercise device 102 in combination with resistance bands 204 and resistance band handles 212. Exercise device 102 provides the ability for the user to perform a variety of exercises while in a standing, kneeling, bent, and/or seated position. Further, the user is able to couple resistance bands 204 to the various attachment points (e.g. 122, 123, and 125) affixed to exercise device 102 to train his or her muscles. Additionally, the user can increase any challenge or level of difficulty by adding more than one resistance band at one time. Further, when the exercise device 102 is in an upright orientation, the user is able to grasp the frame handles 114 to both challenge his or her arm, back, and abdominal muscles and also to provide stability and support while performing a number of exercises, whether the user is in a standing or kneeling position. It is noted that while many of the benefits are related to resistance training as provided by these exercises, it is also possible to obtain somewhat of a cardiovascular workout when doing these exercises, depending on the user's speed, agility, and number of sets and repetitions performed in a row.

Additional benefits of exercise device 102 is that exercise device 102 is easily transportable from place to place, which allows a user to workout in any environment without restriction. Additionally, the resistance bands 204, resistance bands 212, and even mat 202 are also easily portable by carrying these items in a bag or other container. Further, all of the above-mentioned elements of the system for using exercise device 102, according to one or more embodiments, may be relatively easy to store without taking up much space or room. It is easy to imagine that the exercise device 102 may be placed in a closet or in one's residence without having to dedicate a large amount of space for exercise device 102 and its additional accessories (e.g. resistance bands 204). Accordingly, the one or more embodiments described herein provide for an improved workout device that can help a user to achieve his or her fitness goals, including performing resistance training and/or cardiovascular exercise. The exercise device, as described in one or more embodiments herein, may allow a user to strengthen and tone his or her entire body and to perform an incredible variety of exercises using the same exercise device.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. An exercise device, comprising:

a frame defining an empty space, the frame comprising:

a top bar parallel to a bottom bar;

a first side bar, and a second side bar, wherein the top bar is coupled to a top end of the first side bar and to a top end of the second side bar, and the bottom bar is coupled to a bottom end of the first side bar and to a bottom end of the second side bar, wherein the top bar and the bottom bar are shorter in lengths than the first side bar and the second side bar;

a first frame handle that protrudes outwardly from the first side bar;

a second frame handle that protrudes outwardly from the second side bar, wherein the first frame handle and second frame handle are in horizontal alignment regarding a placement of the first frame handle and the second frame handle, wherein a top portion of the first frame handle and a top portion of the second frame handle angle outwardly away from the frame; and a set of attachment points rigidly affixed to the frame, wherein each of the set of attachment points comprise one or more rings configured to receive one or more clips from one or more resistance bands;

wherein a first attachment point of the set of attachment points is affixed to the first side bar and proximately located beneath the first frame handle and a second attachment point of the set of attachment points is affixed to the second side bar and proximately located beneath the second frame handle.

2. The exercise device of claim 1, wherein the first frame handle and the second frame handle are, respectively, coupled near an upper portion of the first side bar and the second side bar.

3. The exercise device of claim 1, wherein the frame encompasses the empty space between the top bar, the bottom bar, the first side bar and the second side bar, and wherein the frame is devoid of an underlying board between the top bar, the bottom bar, the first side bar, and the second side bar.

4. The exercise device of claim 1, wherein a third attachment point of the set of attachment points is affixed to the bottom bar and centrally located on the bottom bar.

5. The exercise device of claim 1, wherein the set of attachment points are selected from any of the group comprising a U-bolt, a D-ring, or an O-ring.

6. The exercise device of claim 1, wherein an angle between the first bar and the first frame handle and between the second bar and the second frame handle is between 20 and 50 degrees.

7. A system for performing a variety of exercises comprising:

a frame defining an empty space, the frame comprising:

a top bar parallel to a bottom bar;

a first side bar, and a second side bar, wherein the top bar is coupled to a top end of the first side bar and to a top end of the second side bar, and the bottom bar is coupled to a bottom end of the first side bar and to a bottom end of the second side bar;

a first frame handle that protrudes outwardly from the first side bar;

a second frame handle that protrudes outwardly from the second side bar, wherein the first frame handle and second frame handle are in horizontal alignment regarding a placement of the first frame handle and the second frame handle, wherein a top portion of the first frame handle and a top portion of the second frame handle angle outwardly away from the frame; and a set of attachment points rigidly affixed to the frame, wherein each of the set of attachment points comprise one or more rings configured for receiving one or more clips from one or more resistance bands;

wherein a first attachment point of the set of attachment points is affixed to the first side bar and proximately located beneath the first frame handle and a second attachment point of the set of attachment points is affixed to the second side bar and proximately located beneath the second frame handle;

a set of resistance bands, wherein each resistance band of the set of resistance bands includes a first clip at one end of each resistance band and a second clip of the one or more clips at the other end of each resistance band;

a set of resistance band handles, wherein each resistance band handle of the set of resistance band handles comprises a connector, a cushioned grip element, and an opening, wherein the set of resistance bands are configured to be removeably fastenable to any one of the set of attachment points and to the connector of the set of resistance band handles.

8. The system for performing the variety of exercises of claim 7, wherein the first frame handle and the second frame handle are, respectively, coupled near an upper portion of the first side bar and the second side bar.

9. The system for performing the variety of exercises of claim 7, wherein a third attachment point of the set of attachment points is affixed to the bottom bar and centrally located on the bottom bar.

10. The system for performing the variety of exercises of claim 7, wherein the set of attachment points are selected from any of the group comprising a U-bolt, a D-ring, or an O-ring.

11. The system for performing the variety of exercises of claim 7, wherein the opening of the resistance band handles is configured to be usable for inserting a user's hand or foot.

12. The system for performing the variety of exercises of claim 7, wherein the set of resistance bands are made of stretchable, extendable material configured to allow the set of resistance bands to stretch and extend when pulled on by a user.

13. The system for performing the variety of exercises of claim 7, wherein the frame is portable.

14. A method of exercising, comprising:

positioning a portable frame on a surface, wherein the portable frame comprises a top bar parallel to a bottom bar, a first side bar, and a second side bar, wherein the top bar is coupled to a top end of the first side bar and to a top end of the second side bar, and the bottom bar is coupled to a bottom end of the first side bar and to a bottom end of the second side bar, a first frame handle that protrudes outwardly from the first side bar, a second frame handle that protrudes outwardly from the second side bar, wherein the first frame handle and second frame handle are in horizontal alignment regarding a placement of the first frame handle and the second frame handle, wherein a top portion of the first frame handle and a top portion of the second frame handle angle outwardly away from the frame, and a set of attachment points rigidly affixed to the frame, wherein each of the set of attachment points comprise one or more rings configured for receiving one or more fasteners from one or more resistance bands;

wherein the set of attachment points further comprise a first attachment point and a second attachment point, wherein the first attachment point is affixed to the first side bar and proximately located beneath the first frame handle and the second attachment point is affixed to the second side bar and proximately located beneath the second frame handle; and coupling the one or more resistance bands to the set of attachment points in order to perform a variety of exercises.

15. The method of exercising of claim 14, further comprising, positioning the portable frame in a horizontal orientation on the surface wherein the first frame handle and the second frame handle point in an upwards direction and a rear side of the portable frame is in contact with the surface.

16. The method of exercising of claim 15, further comprising using the first frame handle and the second frame handle to perform pushups on the portable frame.

17. The method of exercising of claim 14, wherein the set of attachment points further comprises a third attachment point, where the third attachment point is affixed to the bottom bar and substantially centrally located on the bottom bar.

18. The method of exercising of claim 17, further comprising, performing a standing donkey kick to strengthen and tone muscles of a gluteal region and legs of a user further comprising:

clipping one end of the one or more resistance bands to the third attachment point;

inserting one foot into one or more resistance band handles that are coupled to the one or more resistance bands;

gripping the first frame handle and the second frame handle;

positioning the bottom bar of the portable frame on the surface;

balancing on one leg; and extending in a backwards direction a second leg associated with the foot inserted into the one or more resistance band handles while balancing and gripping the upright portable frame.

19. The method of exercising of claim 14, further comprising:

using the portable frame to perform the variety of exercises while holding the portable frame upright by gripping the first frame handle and the second frame handle and positioning the bottom bar of the frame against the surface, wherein a user is in a standing or kneeling or bent position.

20. The method of exercising of claim 14, further comprising:

placing a first foot of a user on the first side bar of the portable frame;

placing a second foot of the user on the second side bar of the portable frame; and grasping the one or more resistance bands with one or both hands of the user to perform any exercise of the variety of exercises using the one or more resistance bands wherein the user is also in a standing, squatting, or bent over position over or on the portable frame.

* * * * *